US011974711B2

(12) United States Patent
Zhang et al.

(10) Patent No.: US 11,974,711 B2
(45) Date of Patent: May 7, 2024

(54) DISH WASHER

(71) Applicants: FOSHAN SHUNDE MIDEA WASHING APPLIANCES MANUFACTURING CO., LTD., Guangdong (CN); MIDEA GROUP CO., LTD., Guangdong (CN)

(72) Inventors: Wei Zhang, Guangdong (CN); Siqi Cai, Guangdong (CN); Fanhua Cheng, Guangdong (CN); Weijun Xue, Guangdong (CN)

(73) Assignees: FOSHAN SHUNDE MIDEA WASHING APPLIANCES MANUFACTURING CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 558 days.

(21) Appl. No.: 16/906,440

(22) Filed: Jun. 19, 2020

(65) Prior Publication Data

US 2020/0315423 A1 Oct. 8, 2020

Related U.S. Application Data

(63) Continuation of application No. PCT/CN2019/092777, filed on Jun. 25, 2019.

(30) Foreign Application Priority Data

Oct. 16, 2018 (CN) ..... 201821681517.1
Oct. 16, 2018 (CN) ..... 201821682028.8

(51) Int. Cl.
*A47L 15/00* (2006.01)
*A47L 15/42* (2006.01)

(52) U.S. Cl.
CPC ..... *A47L 15/0086* (2013.01); *A47L 15/4225* (2013.01); *A47L 15/0084* (2013.01);
(Continued)

(58) Field of Classification Search
CPC ..... A47L 15/0086; A47L 15/4221; A47L 15/4248; A47L 15/4225; A47L 15/0084; A47L 15/4223; A47L 15/4217
See application file for complete search history.

(56) References Cited

U.S. PATENT DOCUMENTS 1,645,815 A * 10/1927 Murdoch ..... A47L 15/16 134/191
1,995,331 A * 3/1935 Snyder ..... A47L 15/0086 134/107
(Continued)

FOREIGN PATENT DOCUMENTS

CN 204542006 U 8/2015
CN 107692940 A 2/2018
(Continued)

OTHER PUBLICATIONS

International Search Report and Written Opinion dated Oct. 8, 2019 received in International Application No. PCT/CN2019/093777.
(Continued)

*Primary Examiner* — Benjamin L Osterhout
(74) *Attorney, Agent, or Firm* — SCULLY SCOTT MURPHY & PRESSER, PC

(57) ABSTRACT

The present disclosure discloses a dish washer. The dish washer includes a container, a spraying duct, and a water supply system. The container has a cleaning area therein. A plurality of spraying devices are provided, and each spraying device is provided with a spraying hole and has a water inflow end. The water supply system is in communication with a water supply and the water inflow end of the spraying
(Continued)

device. According to the dish washer of the present disclosure, water spray can be individually controlled by the multiple water supply systems or by cooperation between one water supply system and the diverter valve. Thus, the dish washer has satisfactory water usage efficiency.

13 Claims, 7 Drawing Sheets

(52) U.S. Cl.
CPC ..... *A47L 15/4217* (2013.01); *A47L 15/4221* (2013.01); *A47L 15/4223* (2013.01); *A47L 15/4248* (2013.01)

(56) References Cited

U.S. PATENT DOCUMENTS 2,076,688 A * 4/1937 West ..... A47L 15/0086 134/191
2,632,452 A * 3/1953 Spitzer ..... A47L 15/16 134/115 R
2,813,534 A * 11/1957 Low ..... A47L 15/0086 241/32.5
3,358,702 A * 12/1967 Schaap ..... E03C 1/266 134/107
3,709,236 A * 1/1973 Field ..... A47L 15/0086 134/107
3,863,657 A * 2/1975 Irving ..... A47L 15/02 134/107
4,146,405 A * 3/1979 Timmer ..... A47L 15/0086 134/115 R
5,934,298 A * 8/1999 Singh ..... A47L 15/0086 134/201
7,040,329 B2 * 5/2006 DeBoer ..... A47L 15/4257 134/182
2003/0205256 A1 * 11/2003 DeBoer ..... A47L 15/0086 134/115 R
2010/0024848 A1 * 2/2010 Della Gaspera .... A47L 15/4225 134/184
2012/0138107 A1 6/2012 Fountain et al.
2013/0269736 A1 10/2013 Baldwin et al.
2016/0324392 A1 * 11/2016 Xu ..... B05B 3/12

FOREIGN PATENT DOCUMENTS

CN 106510584 B 5/2023
DE 102010061346 A1 6/2012
EP 0786230 B1 1/2003
EP 1371319 B1 2/2004
EP 3354184 A1 * 8/2018 ..... A47B 77/08
KR 101857540 B1 5/2018
WO 2005044071 A1 5/2005
WO 2013111170 A2 8/2013

OTHER PUBLICATIONS

Extended European Search Report dated Jul. 13, 2022 received in European Patent Application No. EP 19874478.1.

* cited by examiner

DISH WASHER

CROSS-REFERENCE TO RELATED APPLICATIONS

The present application is a continuation of PCT International Application No. PCT/CN2019/092777, filed on Jun. 25, 2019, which claims priority to Chinese Patent Application Serial No. 201821681517.1 and Chinese Patent Application Serial No. 201821682028.8, filed on Oct. 16, 2018, the entire contents of which are incorporated herein by reference for all purposes. No new matter has been introduced

FIELD

The present disclosure relates to the technical field of kitchen appliances, and more particularly, to a dish washer.

BACKGROUND

With improvements in the lives of people, the demand for dish washers has been greatly increased, and people also make higher requirements for the dish washers. A dish washer is usually provided with a plurality of spraying devices in a washing tank. Due to the different numbers of dishes to be washed each time, not all the spraying devices should be used at the same time when the dishwasher is used each time. However, there is no product that can control respective spraying devices at different locations to be opened or closed, which is not beneficial to water conservation when people use the dish washer. In addition, most of the existing dish washers only have one washing area, which results in that the existing dishwashers cannot perform cleaning with different intensities at different washing areas at the same time.

SUMMARY

An aspect of the present disclosure provides a dish washer, which aims to raise water use ratio of the dish water and perform cleaning of different intensities in different cleaning areas.

To this end, embodiments of a first aspect of the present disclosure provide a dish washer. The dish washer includes: a container having a cleaning area therein; a plurality of spraying devices, each of the spraying devices being provided with a plurality of spraying holes and having a water inflow end; and a water supply system in communication with a water supply and the water inflow end of the spraying device. Any one of the plurality of spraying devices is capable of supplying water to the cleaning area individually.

In some embodiments, the dish washer further includes a diverter valve, the diverter valve has a water inlet end connected to the water supply system and includes a plurality of water output parts, each of the water output parts is in communication with one spraying device, and the plurality of spraying devices are controlled to supply water to the cleaning area by correspondingly controlling opening and closing of the plurality of water output parts.

According to a technical solution of the present disclosure, the spraying devices can be controlled individually by cooperation between one water supply system and the diverter valve, and the diverter valve can individually control each of branches of water or each group of branches of water, by controlling opening and closing of each of the water output parts or each group of the water output parts (the water output parts are divided into groups), which makes it more convenient for users to use the spraying ducts based on their own needs, thereby avoiding waste of water and significantly increasing a use ratio of water. It is worth noting that, the same dish washer can have different cleaning areas by individually controlling the branches of water or groups of branches of water. When a power of the water pump is adjusted, different cleaning intensities can be achieved at different cleaning areas or the same cleaning area, such as a powerful cleaning area and a gentle cleaning area, therefore the users can perform desirable cleaning intensity at different cleaning areas based on their needs.

In some embodiments, dish washer further includes a diverter, the diverter has a water inlet, a water outlet, and a water-diverting chamber in communication with the water inlet and the water outlet, the water inlet is in communication with the water output part, and the water outlet is in communication with a water inflow end of a spraying duct.

In some embodiments, the dish washer further includes a pressure-maintaining duct provided in a water path between the water supply system and the diverter valve or provided in a water path between the diverter valve and the diverter of the dish washer.

In some embodiments, a plurality of water supply systems are provided, each of the spraying devices corresponds to one water supply system, and the plurality of spraying devices are controlled to provide water to the cleaning area by controlling the plurality of water supply systems respectively.

According to a technical solution of the present disclosure, the spraying devices can be controlled individually by the plurality of water supply systems independent from each other, each of the branches of water or each group of branches of water can be controlled individually, such that the same dish washer can have different cleaning areas, thereby avoiding waste of water and significantly increasing a use ratio of water. Different cleaning intensities can be achieved at different cleaning areas or the same cleaning area, such as a powerful cleaning area and a gentle cleaning area, therefore the users can perform desirable cleaning intensity at different cleaning areas based on their needs. It should be noted that, the individual control to the different cleaning areas can be performed with the plurality of water supply systems without a diverter valve.

In some embodiments, a plurality of cleaning areas are provided, the plurality of cleaning areas include a first cleaning area and a second cleaning area, the plurality of water supply systems include a first water supply system and a second water supply system, the first water supply system corresponds to the first cleaning area, the second water supply system corresponds to the second cleaning area, the first water supply system includes a first cup assembly, a first water pump, and a first water supply duct which are connected in sequence, and/or, the second water supply system includes a second cup assembly, a second water pump, and a second water supply duct which are connected in sequence.

In some embodiments, the first water supply system further includes a first water softener, the first water softener is connected to the first cup assembly, and the first water pump and the first water softener are arranged at a diagonal line of a bottom wall of a first washing tank; and the second water supply system further includes a second water softener, the second water softener is connected to the second cup assembly, and the second water pump and the second water softener are arranged at a diagonal line of a bottom wall of a second washing tank.

In some embodiments, the water supply system comprises a cup assembly, a water pump, and a water supply duct which are connected in sequence, the water supply duct has a water inflow end in communication with the water pump and a water outflow end in communication with the spraying duct, and the water outflow end of the water supply duct is in communication with the spraying duct through a pressure-maintaining duct.

In some embodiments, the pressure-maintaining duct has a diameter greater than a diameter of the water supply duct.

In some embodiments, the pressure-maintaining duct has an axis parallel with an axis of a water outlet opening of the water pump, and an offset distance is provided between the axis of the pressure-maintaining duct and the axis of the water outlet opening of the water pump.

In some embodiments, the pressure-maintaining duct has a water inflow end provided with an inlet port, the inlet port is smaller than a diameter of the pressure-maintaining duct, and the inlet port is formed at a side of the pressure-maintaining duct adjacent to the water pump.

In some embodiments, the container has a washing tank therein, the washing tank is provided with a movable partition plate therein, and the partition plate partitions the washing tank into a plurality of cleaning areas.

In some embodiments, a plurality of spraying ducts are arranged along a length direction or a width direction of the washing tank.

In some embodiments, a bottom of the cleaning area is provided a protruding sealing wall corresponding to the partition plate, and a bottom of the partition plate sealingly abuts the sealing wall.

To achieve the above objective, embodiments of a second aspect of the present disclosure provide a dish washer. The dish washer includes: a spraying device comprising a plurality of spraying ducts, each of the spraying ducts having a water intake and a spraying hole defined in a duct body; a water pump having a water inlet opening in communication with a water supply; and a diverter valve having a water inlet end in communication with a water outlet opening of the water pump, the diverter valve comprising a plurality of water output parts in communication with the spraying ducts, and water supply to the spraying ducts is controlled by controlling opening and closing of the water output parts of the diverter valve.

In some embodiments, the dish washer further includes one cup assembly and a washing tank, the cup assembly is arranged at a bottom of the washing tank, the spraying ducts are arranged in the washing tank, one water pump is provided to drive water in the washing tank to flow from the cup assembly into the spraying ducts through the diverter valve and be sprayed into the washing tank through the spraying hole.

In some embodiments, the dish washer further includes a diverter, the diverter has a water inlet, a water outlet, and a water-diverting chamber in communication with the water inlet and the water outlet, the water inlet is in communication with the water output part, and the water outlet is in communication with the spraying duct.

In some embodiments, a plurality of water-diverting chambers are provided, and the plurality of water-diverting chambers are separated from each other.

In some embodiments, the diverter includes: a housing with the water inlet located in a side of the housing; a water-inlet pipe arranged at the water inlet; and a water-outlet pipe arranged at the water outlet.

In some embodiments, the diverter further includes a chamber-partition board extending from a bottom of the housing into the water-inlet pipe, and the plurality of water-diverting chambers are formed and separated from each other.

In some embodiments, the diverter further includes an interception plate, and the interception plate is movably connected to the water-inlet pipe to close or open an area enclosed by the chamber-partition board and an inner wall of the water-inlet pipe.

In some embodiments, the spraying duct is connected to the water-outlet pipe directly or through a hose.

In some embodiments, the diverter is arranged at a bottom of the washing tank of the dish washer and adjacent to the water intake of the spraying duct, and the water outlet is oriented towards the water intake.

In some embodiments, the dish washer includes a washing tank, a plurality of spraying ducts are arranged along a length direction or a width direction of the washing tank.

In some embodiments, the dish washer further includes a pressure-maintaining duct provided in a water path between the water pump and the diverter valve or provided in a water path between the diverter valve and a diverter of the dish washer.

In some embodiments, the dish washer includes a washing tank, a bottom of the washing tank is provided with a protruding sealing wall, and a top of the sealing wall is provided with one of a sealing groove and a sealing rib; and the washing tank further includes a partition plate, a bottom of the partition plate is provided with the other one of the sealing rib and the sealing groove, and the partition plate is sealingly connected to the sealing wall by the sealing rib and the sealing groove.

In the solution of the present disclosure, with the diverter valve, water supplied from the water pump needs to be divided by the diverter valve and then enters each of the spraying ducts. When the water passes through the diverter valve, the diverter valve divides the water in to branches of water, and the branches of water enter the spraying ducts through the plurality of water output parts respectively. The diverter valve can individually control each of the branches of water or each group of branches of water, by controlling opening and closing of each of the water output parts or each group of the water output parts (the water output parts are divided into groups), which makes it more convenient for users to use the spraying ducts based on their own needs, thereby avoiding waste of water and significantly increasing a use ratio of water. It is worth noting that, the same dish washer can have different cleaning areas by individually controlling the branches of water or groups of branches of water. When a power of the water pump is adjusted, different cleaning intensities can be achieved at different cleaning areas or the same cleaning area, such as a powerful cleaning area and a gentle cleaning area, therefore the users can perform desirable cleaning intensity at different cleaning areas based on their needs.

BRIEF DESCRIPTION OF THE DRAWINGS

In order to more clearly explain embodiments of the present application or technical solutions in the prior art, the drawings needed in description of the embodiments or the prior art are simply introduced hereafter. Obviously, the drawings in the following description are only some embodiments of the present application, other drawings can be obtained by persons of ordinary skill in the art based on the drawings without creative efforts.

Figure 1:
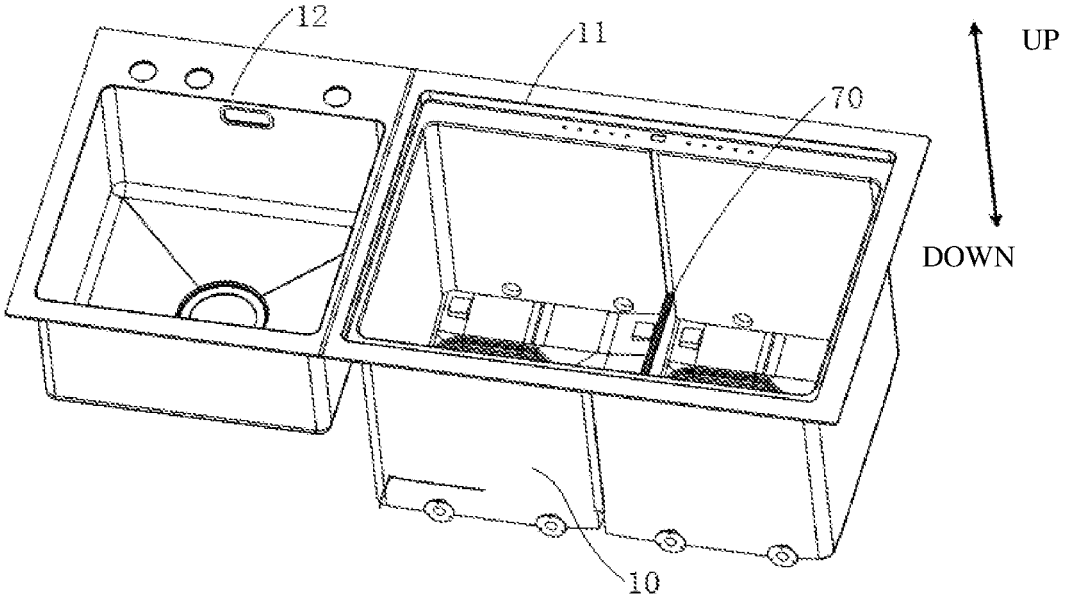
FIG. 1 is a schematic view of a dish washer according to an embodiment of the present disclosure.

REFERENCE NUMERALS container 10, washing tank 11, first washing tank 111, second washing tank 112, sink 12, first fixing member 13, second fixing member 14, spraying duct 20, driving device 30, water supply system 40, water softener 401, water pump 402, water supply duct 403, cup assembly 404, first water supply system 41, first water softener 411, first water pump 412, first water supply duct 413, second water supply system 42, second water softener 421, second water pump 422, second water supply duct 423, pressure-maintaining duct 50, water inflow end 51 of pressure-maintaining duct, water outflow end 52 of pressure-maintaining duct, inlet port of pressure-maintaining duct 53, hose 54, partition plate 60, sealing groove 61, sealing wall 70, sealing rib 71, diverter valve 80, diverter 90, water inlet 91, water outlet 92, water-diverting chamber 93, water-inlet pipe 94, water-outlet pipe 95, chamber-partition board 96, housing 97.

DETAILED DESCRIPTION OF EMBODIMENTS

The present application will be described clearly and integrally in conjunction with the accompanying drawings and embodiments. Obviously, the described embodiments are only a part of embodiments of the present application, not all embodiments of the present application. All other embodiments obtained by persons of ordinary skill in the art based on the embodiments of the present disclosure without creative efforts shall fall within the protection scope of the present application.

It should be noted that if there are indications relating to orientation in the embodiments of the present application, such as "up", "down", "left", "right", "front", "rear", etc. The indications are only used to describe relative locations and movements of components in a particular position (as shown in the drawings), and the indications relating to the orientation change along with changes of the particular position.

In addition if there is description relating to terms such as "first" and "second", such terms are used for purposes of description and are not intended to indicate or imply relative importance or significance or to imply the number of indicated technical features. Thus, the feature defined with "first" and "second" may comprise one or more of this feature, whether implicit or explicit. In addition, technical solutions of respective embodiments can be combined mutually on the premise that persons of ordinary skill in the art can achieve proposed combinations. It should be noted that the proposed combinations of the technical solutions should be deemed as inexistence and out of the protection scope of the present application, when there is contradiction in the proposed combinations of the technical solutions or the proposed combinations of the technical solutions cannot be implemented.

The present disclosure mainly proposes a washing system which is mainly used in a washing apparatus, for example, a dish washer. The dish washer may be a drawer-type dish washer or a sink-type dish washer. In the present disclosure, the sink-type dish washer is used as an example.

As shown in FIG. 1 to FIG. 14, the dish washer of the present disclosure includes a container 10, a spraying device the spraying device and a water supply system. The container 10 has a washing tank 11, and as for the sink-type dish washer, the container 10 also has a sink 12. There may be one, two, or more than two washing tanks 11. For example, two washing tanks 11 are provided, and the two washing tanks 11 can be in communication with each other or independent from each other. In some embodiments, the washing tank 11 can be provided with a partition plate therein, the two washing tanks 11 are in communication with each other before the partition plate is mounted, and the two washing tanks 11 are independent from each other after the partition plate is mounted.

Figure 4:
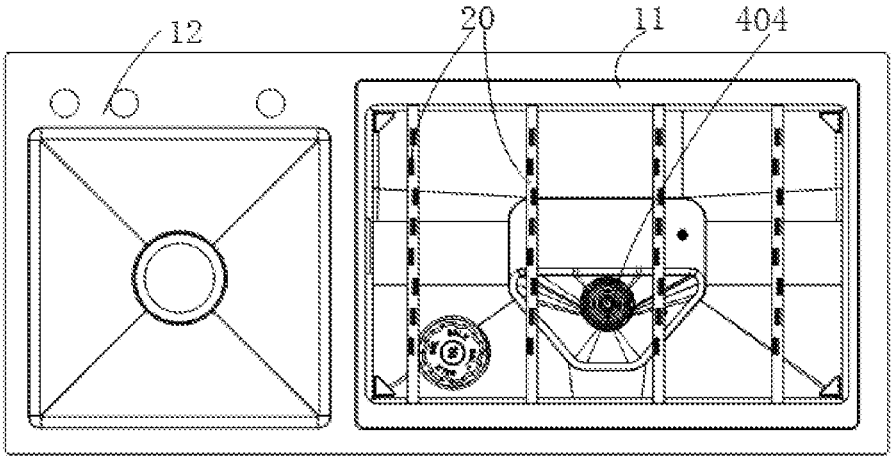
FIG. 4 is a schematic view of a dish washer according to another embodiment of the present disclosure.
Figure 5:
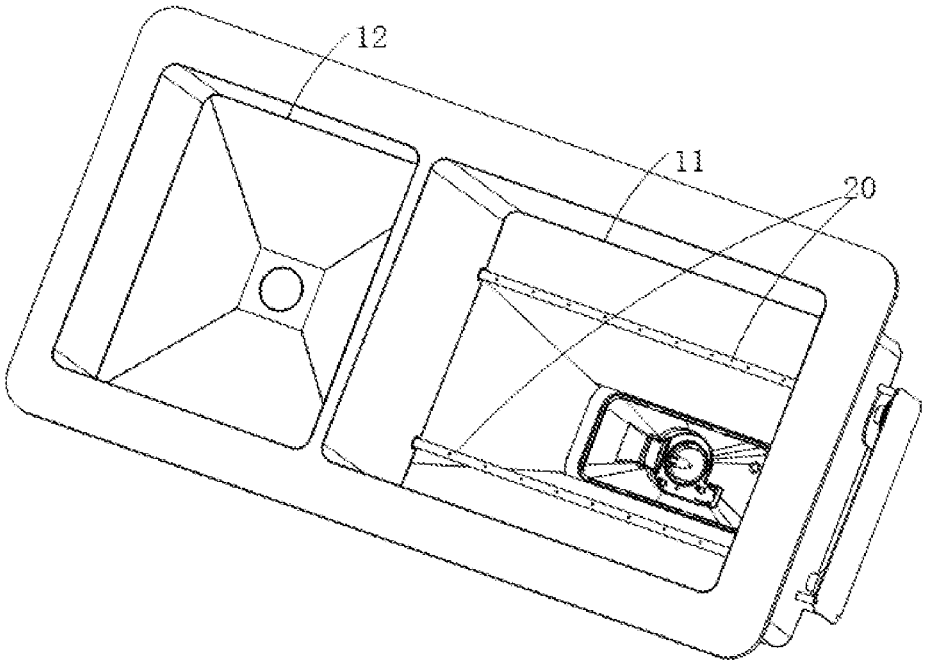
FIG. 5 is a schematic view of a dish washer according to still another embodiment of the present disclosure.

As shown in FIG. 4 and FIG. 5, the spraying device includes one or more spraying ducts 20. Each spraying duct 20 has a water intake and a spraying hole provided on a body of the spraying duct 20. In other words, in this embodiment, the spraying device is configured to be in the form of the one or more spraying ducts 20, and each spraying duct 20 has a water intake and one or more water spraying holes. The spraying device may be configured to be in other forms, such as a nozzle, a head, a spraying arm, etc.

For example, the plurality of spraying ducts 20 are arranged along a length direction of the washing tank 11, or along a width direction of the washing tank 11. A length direction of the plurality of spraying ducts 20 may be the same as the width direction of the washing tank 11 (i.e., in an arrangement along the length direction of the washing tank 11), or may be the same as the length direction of the washing tank 11 (i.e., in an arrangement along the width direction of the washing tank 11). Each spraying duct 20 has the spraying holes, and the plurality of spraying ducts 20 are arranged and mounted in the washing tank 11. The spraying holes are arranged in the same straight line or offset in different straight lines, along the length direction of the spraying duct 20.

A water supply system 40 allows a water supply to be in communication with a water inflow end of the spraying ducts 20, such that the water supply system provides water into the spraying ducts 200.

As shown in FIG. 2 to FIG. 9, there may be one or more water supply systems 40. When one water supply system 40 is provided, the dish washer also includes a diverting part, such as a diverter valve 80, etc. The single water supply system 40 cooperates with the diverter valve 80 to supply water into the plurality of spraying ducts 20, such that the spraying ducts 20 can be controlled individually and/or independently. When a plurality of water supply systems 40 are provided, the plurality of spraying ducts 20 are controlled through the plurality of water supply systems 40 respectively, the spraying ducts 20 can be controlled individually without the diverter valve.

Figure 2:
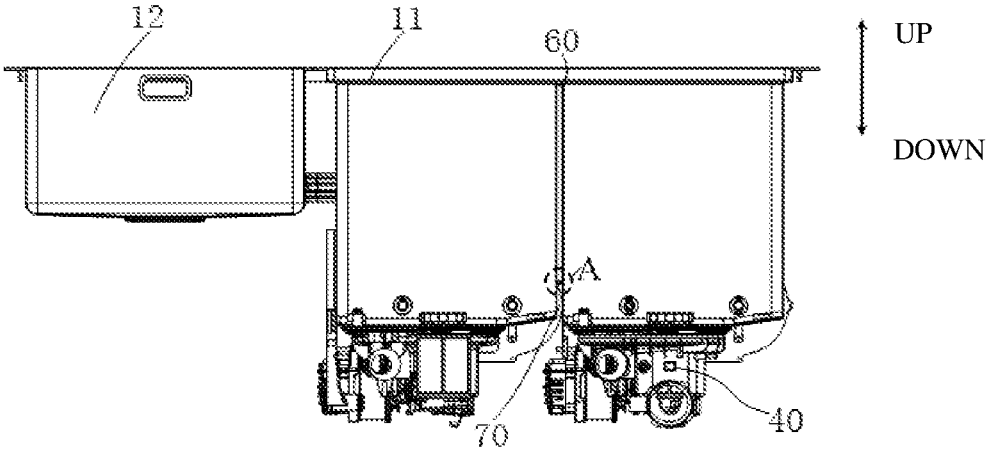
FIG. 2 is a schematic view of FIG. 1 from a different perspective.
Figure 12:
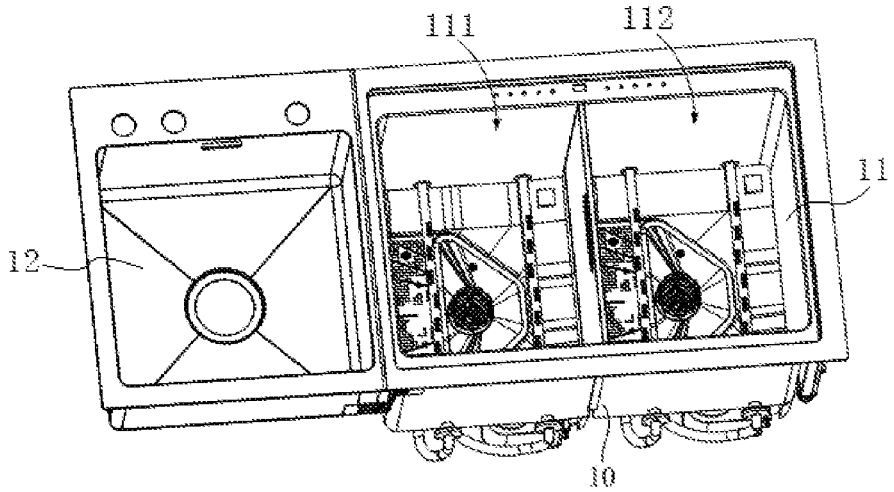
FIG. 12 is a schematic view of a dish washer according to another embodiment of the present disclosure, in which two water supplies system are provided.

In some embodiments, as shown in FIG. 2 and FIG. 12, the washing tank 11 is provided with a movable partition plate 60 therein, such that the container 10 can be partitioned into a first washing tank 111 and a second washing tank 112. When the partition plate 60 is mounted, the partition plate 60 divides the container 10 into the first washing tank 111 and the second washing tank 112. When the partition plate 60 is dismounted, the first washing tank 111 and the second washing tank 112 are in communication with each other, such that the container 10 can receive tableware of a larger size, such as a cookware, a large dish, etc.

A detachable structure for the partition plate 60 is described in detail now. In this embodiment, an inner wall of the container 10 is provided with a groove extending along an up-down direction of the container 10, the partition plate 60 is mounted in the groove in a drawable mode. As an optimal implementation, an upper portion of the partition plate 60 is provided with a grip recess, such that the partition plate 60 can be easily held and pulled.

Figure 3:
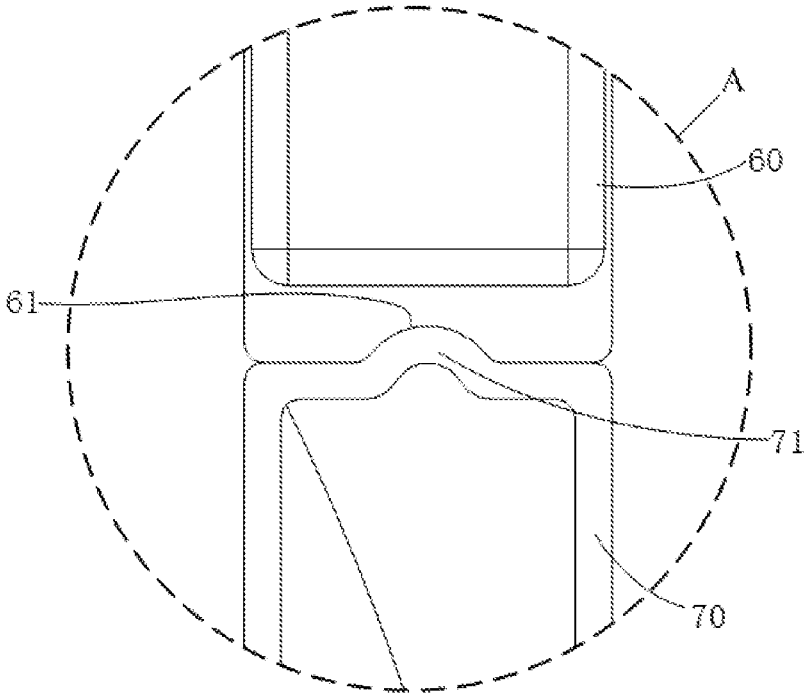
FIG. 3 is a partially enlarged view of part A in FIG. 2.

Furthermore, referring to FIG. 3, in order to improve leak-proofness of the partition plate 60 (that is, in order to prevent water from leaking through the partition plate 60), in an embodiment of the present disclosure, a bottom of the washing tank 11 is provided with a protruding sealing wall 70 corresponding to the partition plate 60. A top of the sealing wall 70 is provided with a sealing groove or a sealing rib, and a bottom of the partition plate 60 is provide with a corresponding sealing rib or a corresponding sealing groove. Thus, the partition plate 60 can be sealingly connected to the sealing wall 70 through engagement between the sealing rib and the sealing groove. For example, the sealing wall 70 is provided with the sealing rib 71, and the bottom of the partition plate 60 is provided with the sealing groove 61, a portion for sealing the partition plate 60 and the bottom of the washing tank 11 is moved up with the sealing wall 70, such that a sealing position at the bottom is moved up, a water pressure on the sealing position is reduced greatly, and possibility of leakage is reduced significantly. In addition, the sealing groove 61 is easy to arrange, which is beneficial to machining the sealing groove 61 and fitting with the sealing rib 71. The sealing wall 70 can be arranged integrally with the washing tank 11 or sealingly and fixedly connected to the washing tank 11, thereby sufficiently ensure sealing between the sealing wall 70 and the washing tank 11.

Furthermore, the water supply system 40 is described now. As shown in FIGS. 2, 4, 6 and 7, the water supply system 40 includes a water softener 401, a water pump 402, a water supply duct 413, and a cup assembly 404. A position for providing the water softener 401 may be varied, such as a position between the water pump 402 and the water supply source, and a position between the water pump 402 and the water supply duct 403. For example, water passes through the water softener 404 and enters the water pump 402 through the cup assembly 404. The water pump 402 may be in many forms, such as, an electric water pump.

The cup assembly 404 is arranged at the bottom of the washing tank 11, and has a first end in communication with the washing tank 11 and a second end in communication with a water inlet opening of the water pump 402. For example, the cup assembly 404 is arranged at the bottom of the washing tank 11 and connected to a water discharge port at the bottom of the washing tank 11, and water in the washing tank 11 can flow out through the cup assembly 404.

The water softener 401, the cup assembly 404, the water pump 402, and the water supply duct 403 are sequentially connected to one another. The water softener 401 is in communication with an external water supply source, the water supply duct 403 is in communication with the spraying ducts 20, external water supply enters and is softened by the water softener 401, and is subsequently stored in the cup assembly 404. The water pump 402 drives water in the washing tank 11 to flow from the cup assembly 404 into the spraying ducts 20 through the water supply duct 403, and subsequently the water is sprayed into the washing tank 11 through the spraying holes on the spraying ducts 20.

Figure 6:
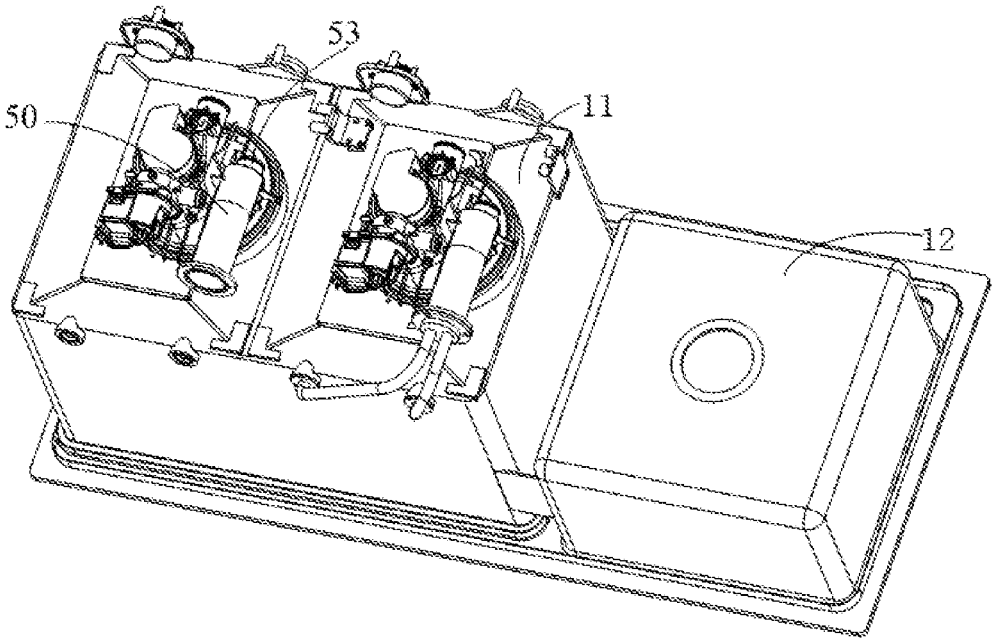
FIG. 6 is a schematic view of a dish washer according to yet another embodiment of the present disclosure.
Figure 7:
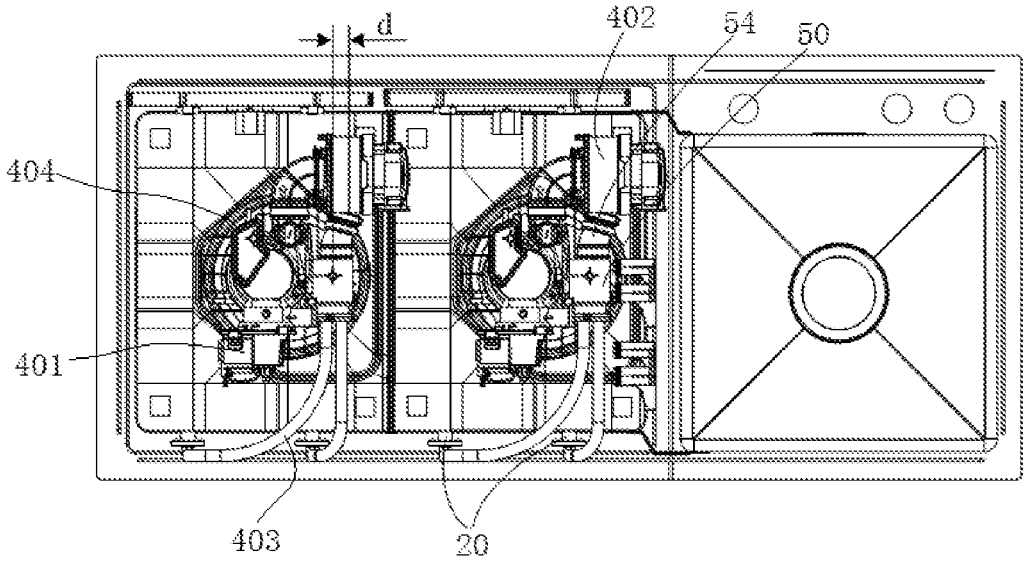
FIG. 7 is a top view of the dish washer shown in FIG. 6.
Figure 8:
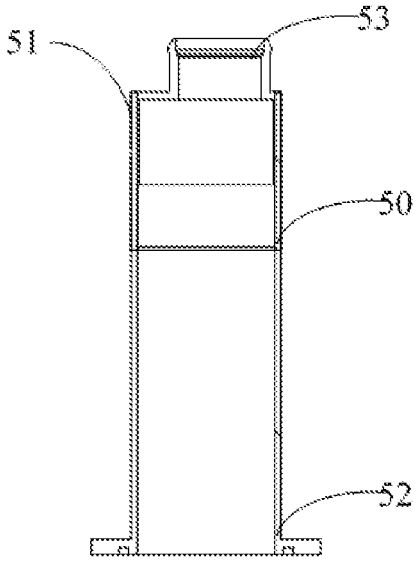
FIG. 8 is a schematic view of a pressure-maintaining duct of a dish washer of the present disclosure.

In some embodiments, as shown in FIG. 6 to FIG. 8, the dish washer also includes a pressure-maintaining duct 50, a water inflow end 510 of the pressure-maintaining duct 50 is in communication with a water outlet opening of the water pump 402, and a water outflow end 520 of the pressure-maintaining duct 50 is in communication with water intakes of the plurality of spraying ducts 20. A plurality of materials can be used for the pressure-maintaining duct 50, such as rigid plastic, metal, etc. Certainly, in some embodiments, in order to meet different work requirements, the pressure-maintaining duct 50 also may be made of plastic of certain flexibility, etc.

In this embodiment, under action of the water pump 402, water enters the pressure-maintaining duct 50 through the water outlet opening of the water pump 402, and enters the spraying ducts 20 after passing through the pressure-maintaining duct 50. The water for washing is received in the pressure-maintaining duct 50 firstly, water pressure in the pressure-maintaining duct 50 can be maintained due to direct fluid communication between the pressure-maintaining duct 50 and the water pump 402 (without other element provided therebetween). A distance between the water of high pressure and the spraying duct 20 is very small after transportation through the pressure-maintaining duct 50, loss of water pressure due to transportation of water in a pipeline is greatly reduced. In the related art, the water pump and the spraying ducts are connected through water pipes respectively, and water in the different spraying ducts travels different distances. In contrast, in the present disclosure, water entering the spraying ducts 20 travels an equivalent distance. Therefore, in the present disclosure, the effect, that water entering the spraying ducts from different paths has different pressures due to different journeys in transportation, can be prevented. Furthermore, water entering the plurality of spraying ducts 20 has an equivalent pressure because of the pressure-maintaining duct 50. As a result, the plurality of spraying ducts 20 work at an equivalent efficiency, washing effect of the washing system is more uniform, and the undesirable effect that some spraying ducts 20 are poor at spraying and washing since they are arranged at a distance too far away the water pump 402 can be prevented. With the pressure-maintaining duct 50, not only the uniformity of the washing system is improved, but also the spraying and washing efficiency of the spraying duct 20 is guaranteed, thereby improving washing performance of the washing system.

In some embodiments, in order to improve the compactness of structure and utility rate of space, the pressure-maintaining duct 50 and the water pump 402 are both arranged at the bottom of the washing tank 11. Furthermore, the water pump 402 is arranged adjacently to a side wall of the washing tank 11, the pressure-maintaining duct 50 is arranged adjacently to a middle portion of the bottom of the washing tank 11, and an offset distance is provided between the water inflow end 51 of the pressure-maintaining duct 50 and the water outlet opening of the water pump 402. The water pump 402 is arranged directly under the washing tank 11 and located at an end of the washing tank 11. Meanwhile, in order to make a water outflow end 52 of the pressure-maintaining duct 50 more adjacent to the water intake of the spraying duct 20, the pressure-maintaining duct 50 is arranged adjacently to the middle portion of the bottom of the washing tank 11. By arranging the offset distance between the water inflow end 51 of the pressure-maintaining duct 50 and the water outlet opening of the water pump 402, mounting requirements for the water pump 402 and the pressure-maintaining duct 50 can be both taken into consideration. In some embodiments, in order to utilize space more sufficiently and reasonably, the bottom of the washing tank 11 is also provided with a water path structure, such as the cup assembly 404, the water softener 401, etc. The water softener 401 and the water pump 402 are diagonally arranged, and the water pump 402 assembly is located between the water pump 402 and the water softener 401.

In some embodiments, in order to counter reduction of water pressure from the water pump 402 to the pressure-maintaining duct 50, an axis of the pressure-maintaining duct 50 is parallel with an axis of the water outlet opening of the water pump 402. That means a length direction of the pressure-maintaining duct 50 is in line with a water output direction of the water outlet opening of the water pump 402 (in which a certain included angle is allowable, such as 5 degrees), such that water flows out of the water pump 402 in a direction the same as a flowing direction in the pressure-maintaining duct 50, which minimizes the loss of water pressure. In order to meet both of position requirements of the water pump 402 and the pressure-maintaining duct 50, an offset distance d is provided between the axis of the pressure-maintaining duct 50 and the axis of the water outlet opening of the water pump 402. The pressure-maintaining duct 50 and the water outlet opening of the water pump 402 are in parallel but not collinear. The offset distance d can be set according to actual conditions, such as the offset distance ranges from 1 mm to 200 mm, for example ranges from 5 mm to 30 mm.

A length of the pressure-maintaining duct 50 ranges from 60 mm to 80 mm, and a radial dimension of the pressure-maintaining duct 50 ranges from 20 mm to 30 mm. The length of the pressure-maintaining duct 50 should not be too long, which otherwise affects the layout of other parts. The length of the pressure-maintaining duct 50 should not be too short, which otherwise affects pressure maintaining. A diameter of the pressure-maintaining duct 50 should not be too large, which otherwise makes it difficult to mount, occupies too much space, and is adverse to reasonable layout. The diameter of the pressure-maintaining duct 50 should not be too small, which otherwise cannot guarantee a volume of the pressure-maintaining duct 50 and then affects pressure maintaining thereof.

In order to facilitate offset arrangement of the pressure-maintaining duct 50 and the water pump 402, the water inflow end 51 of the pressure-maintaining duct 50 is provided with an inlet port 53, and the inlet port 53 is offset towards the water pump 402. The inlet port 53 is less than the diameter of the pressure-maintaining duct 50 and provided at a side of the pressure-maintaining duct 50 adjacent to the water pump 402. In such an arrangement, an inclined angle (an angle included between a water pipe and the pressure-maintaining duct 50) of the water pipe connecting the pressure-maintaining duct 50 to the water pump 402 is reduced, which further facilitates flowing of water and reduces reduction of the water pressure.

In some embodiments, in order to make connection between the pressure-maintaining duct 50 and the water pump 402 more flexible and convenient, the inlet port 53 and the water outlet opening of the water pump 402 are connected through a hose 54. The hose may be in many forms, such as a plastic hose, for example a rubber hose. Another end of the pressure-maintaining duct 5 is provided with a cap, and the cap is provided with a flexible water pipe in communication with the spraying duct. There are many ways to realize connection between the cap and the pressure-maintaining duct 50, such as screw connection, snapping connection, adhering connection, direct tight-fit snapping connection.

In some embodiments, in order to improve stability of mounting the pressure-maintaining duct 50 and reduce steps for mounting the pressure-maintaining duct 50 and vibration of the pressure-maintaining duct 50, the pressure-maintaining duct 50 and the cup assembly 404 are integrally formed. Since the pressure-maintaining duct 50 and the cup assembly 404 are integrally formed by injection molding, the vibration of the pressure-maintaining duct 50 during operation needs to overcome loads on the cup assembly 404, such that the pressure-maintaining duct 50 is not easy vibrate due to the large loads on the cup assembly 404. Failure of mounting due to the vibration can be avoided, and the stability of mounting the pressure-maintaining duct 50 can be improved and noises can be effectively reduced.

In other embodiments, a detachable connection is provided between the pressure-maintaining duct 50 and the cup assembly 404. A bottom of the cup assembly 404 is provided with a snapping structure with a snapping groove, and the pressure-maintaining duct 50 is snapped into the snapping groove. Since the detachable connection is provided between the pressure-maintaining duct 50 and the cup assembly 404, the pressure-maintaining duct 50 can be conveniently maintained and replaced. The snapping groove is in a shape of an arc and abuts an outer side wall of the pressure-maintaining duct 50 by a large margin, such that the pressure-maintaining duct 50 is effectively fixed to the cup assembly 404.

In some embodiments, in order to save cost, under the condition of ensuring cleaning efficiency of each spraying duct, the water supply system is used as little as possible. For example, one water pump 402 supplies water to the plurality of spraying ducts 20, that is, the water supply system 40 supplies water to all the plurality of spraying ducts 20. In order to achieve individual control, one water supply system 40 needs to cooperate with diverter parts, such as a diverter valve 80. In other embodiments, in order to individually control different spraying ducts and further increase impact force of water output from the spraying duct, a plurality of water supply systems are provided, for example, two water supply systems supply water to four spraying ducts.

Figure 9:
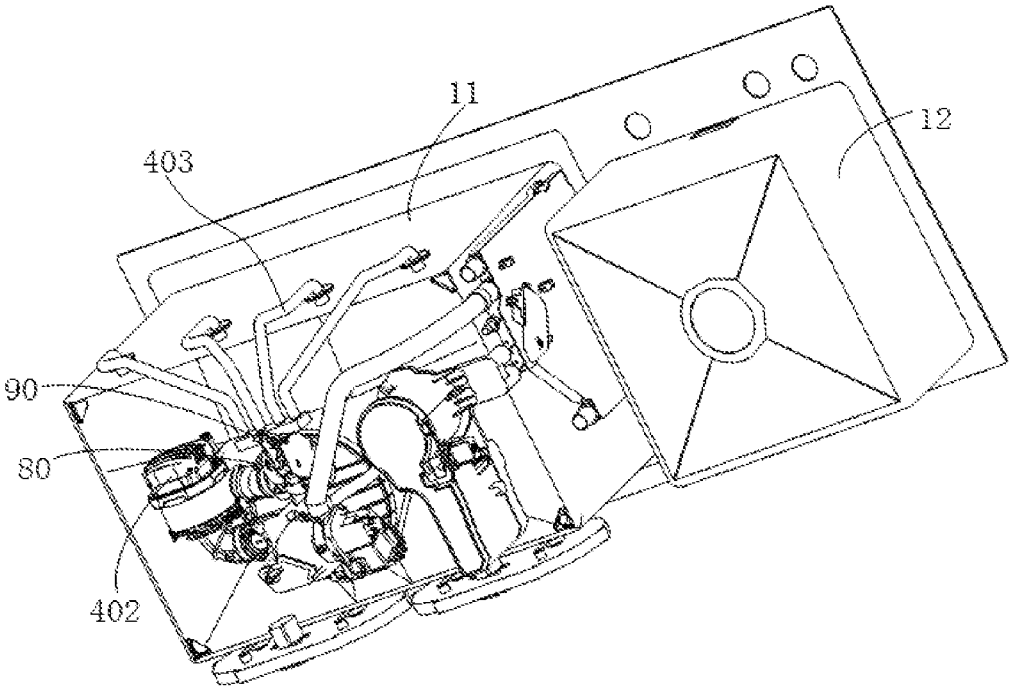
FIG. 9 is a schematic view of a dish washer according to an embodiment of the present disclosure, in which one water supply system is provided.
Figure 10:
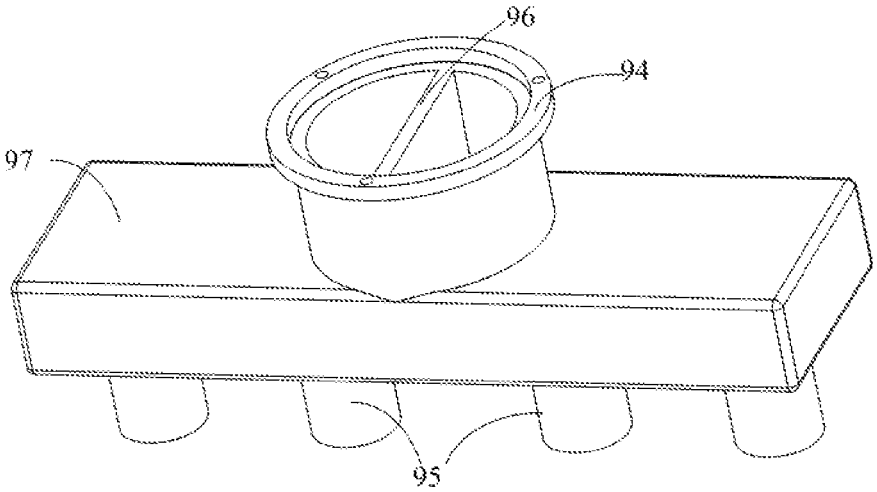
FIG. 10 is a schematic view of a diverter of FIG. 9.
Figure 11:
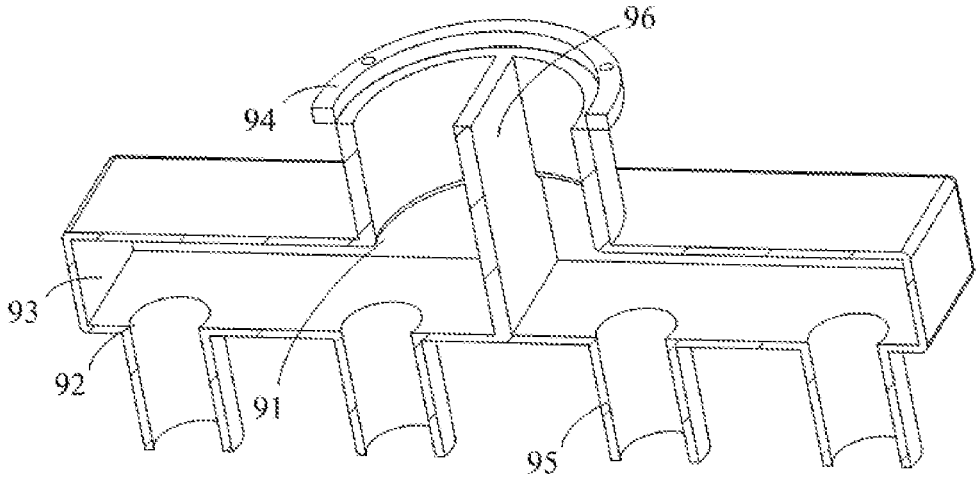
FIG. 11 is a schematic sectional view of the diverter of FIG. 10.

An example is described in detail hereafter, in which one water supply system supplies water to all the plurality of spraying ducts through a structure, such as the diverter valve 80 and the like, and individual control is achieved, as shown in FIG. 9 to FIG. 11.

The dish washer has one water supply system 40, which means that the dish washer has only one water pump 402. In order to achieve individual control, the dish washer further includes the diverter valve 80.

A water inlet end of the diverter valve 80 is in communication with the water outlet opening of the water pump 402, the diverter valve 80 includes a plurality of water output parts, and the water output parts are in communication with the spraying ducts 20, such that the diverter valve 80 is used to control water supplying to the spraying ducts 20 by controlling (throttling or allowing) the water flow through the water output parts. The diverter valve 80 may be in various forms, as along as the water supply can be divided into branches of water, and each of the branches of water can be individually controlled. For example, the diverter valve 80 is a one-way-in and two-way-out valve, the diverter valve 80 has three positions which respectively correspond to a state in which a first water output part is opened, a state in which a second water output part is opened, and a state in which both the first water output part and the second water output part are opened. Taking a ball valve for example, when a first water output valve is opened, the ball valve blocks the second water output part; when a second water output valve is opened, the ball valve blocks the first water output part; and when both of the first water output valve and the second water output valve are opened, the ball valve is located at a third position.

In this embodiment, with the diverter valve 80, water supplied from the water pump 402 needs to be divided by the diverter valve 80 and then enters each of the spraying ducts 20. When the water passes through the diverter valve 80, the diverter valve 80 divides the water into branches of water, and the branches of water enter the spraying ducts 20 through the plurality of water output parts respectively. The diverter valve 80 can individually control each of the branches of water or each group of branches of water, by controlling opening and closing of each of the water output parts or each group of the water output parts (the water output parts are divided into groups), which makes it more convenient for users to use the spraying ducts 20 based on their own needs, thereby avoiding waste of water and significantly increasing the efficiency of water.

It is worth noting that, the same dish washer can have different cleaning areas by individually controlling the branches of water or groups of branches of water. When a power of the water pump is adjusted, different cleaning intensities can be achieved at different cleaning areas or the same cleaning area, such as a powerful cleaning area and a gentle cleaning area, therefore the users can perform desirable cleaning intensity at different cleaning areas based on their needs.

In some embodiments, in order to provide better water distribution and control, the dish washer further includes the diverter 90. The diverter 90 has a water inlet 91, a water outlet 92, and a water-diverting chamber 93 in communication with the water inlet 91 and the water outlet 92. The water inlet 91 is in communication with the water output parts, the water outlet 92 is in communication with the spraying ducts 20. The diverter 90 is arranged downstream of the diverter valve 80 and cooperates with the diverter valve 80, water flow after division by the diverter valve 80 is in communication with the water inlet 91 of the diverter 90. It is noteworthy that, one diverter 90 can have only one water inlet 91, or can have a plurality of water inlets 91. Correspondingly, there may be a plurality of types of communications between the water output parts and the water inlet 91. For example, each of the water output parts corresponds to one water inlet 91, or each of the water output parts corresponds to a plurality of water inlets 91. For example, the number of the water output part(s) corresponds to that of the water inlet(s) 91. Regarding correspondence between the water outlet 92 and the water inlet 91, one water inlet 91 can correspond to one water outlet 92, or one water inlet 91 can correspond to a plurality of water outlets 92, for example, one water inlet 91 and correspond to the plurality water outlets 92. A completed example is described as follows, in which one water output part corresponds to one water inlet 91 and a plurality of water outlets 92. Opening and closing of the one water inlet 91 and the plurality of water outlet 92 can be controlled by controlling opening and closing of the one water output part. With the diverter 90, the number of branches of water can be further increased, which enables the diverter valve 80 to control more spraying ducts 20; and the number of the controlled spraying ducts 20 can be adjusted by adjusting the number of the water outlets 92 corresponding to each of the water inlets 91.

In order to provide better water distribution, a plurality of water-diverting chambers 93 are provided, and the plurality of the water-diverting chambers 93 are spaced apart from each other. One water-diverting chamber 93 corresponds to one water inlet 91 and the plurality of water outlets 92. Water enters the water-diverting chamber 93 through the one water inlet 91 and leaves through the plurality of water outlets 92. The plurality of spaced part water-diverting chambers 93 are divided from one big cavity. For example, two water-diverting chambers 93 are provided, and the two water-diverting chambers 93 can have two water inlets 91 independent from each other, or the same one water inlet 91 is divided into two parts separated from each other, in this case, the two separated parts form two adjacent water inlets 91. Water mixing between adjacent water-diverting chambers 93 can be prevented by mutually separating the water-diverting chambers 93 from each other completely.

It is noteworthy that, the diverter 90 can be arranged at a plurality of positions, such as two ends and a front side of the washing tank 11, and the like. In this embodiment, for example, the diverter 90 is arranged at the bottom of the washing tank 11 and adjacent to an end of the water intake of the spraying duct 20. For example, the diverter 90 is arranged at the bottom of the washing tank 11 of the dish washer, and the diverter 90 is located at a position adjacent to the water intake of the spraying duct 20, and the water outlet is towards the water intake. Since the diverter 90 is adjacent to the inlet of the spraying duct 20 and the water outlet 92 of the diverter 90 is towards the water intake of the spraying duct 20, such that water flows smoothly from the diverter 90 to the spraying duct at a shorter distance, and this can help to reduce energy loss of water flow in the process, raise a water pressure of water flow entering the spraying duct, and raise cleaning efficiency of the dish washer.

A function of the diverter 90 is described hereinafter through an example.

The diverter 90 includes a housing 97, a water inlet 91 located at a side of the housing 97, a water-inlet pipe 94 arranged at the water inlet 91, a water-outlet pipe 95 arranged at a water outlet 92.

For example, the housing 97 has an overall rectangular appearance and is hollow inside. The water-inlet pipe 94 is mounted to the water inlet 91, such that water divided by the diverter valve 80 can enter the water-diverting chamber 93 of the housing 97 through the water-inlet pipe 94. The water-outlet pipe 95 is arranged at the water outlet 92, a plurality of water-outlet pipes 95 are arranged along a length direction of the housing 97. The water-inlet pipe 94 has a diameter larger than a diameter of the water-outlet pipes 95. In this case, one water-inlet pipe 94 corresponds to one water output part of the diverter valve 80. When the diverter 90 has a plurality of water inlets 91, one diverter 90 corresponds to the plurality of water output parts, or one water-inlet pipe 94 corresponds to the plurality water output parts (referring to embodiments as follows).

In order to improve utility rate of space, one diverter 90 is divided into a plurality of water diversion systems by a water separation plate. The diverter 90 further includes a chamber-partition board 96, and the chamber-partition board 96 extends from a bottom of the housing 97 into the water-inlet pipe 94 to form a plurality of water-diverting chambers 93 separated from each other. The chamber-partition board 96 extends from the water-inlet pipe 94 to a bottom of an outer frame to completely partition the water-inlet pipe 94 and an inner chamber of the housing into a plurality of independent parts. In this case, one water-inlet pipe 94 corresponds to a plurality of water feeding systems, and one water inlet 91 also can be divided into a plurality parts correspondingly. The number can be set based on practical needs, for example, the number can be two, i.e., both of the water-inlet pipe 94 and the chamber of the housing 97 are divided into two part independent from each other. In this case, for example, the number of the water-outlet pipes 95 corresponding to each of the water-diverting chambers 93 is two.

It is noteworthy that, the water-inlet pipe 94, the housing 97 and the water-outlet pipe 95 can be integrally formed. The water-inlet pipe 94 can be connected to the diverter valve 80 by a water pipe, or the water-inlet pipe 94 is connected to the diverter valve 80 directly. A plurality of types of connection can be provided, such as snapping connection, screw connection, or flanged connection, etc.

In some other embodiments, in order to further improve control of the water supply system, the diverter 90 can control water supply to each water-diverting chamber 93. For example, the diverter 90 also includes an interception plate (not shown). The interception plate is movably connected to the water-inlet pipe 94 to close or open an area defined by the chamber-partition board 96 and an inner wall of the water-inlet pipe 94. The interception plate cooperates with the water-inlet pipe 94, and the interception plate has three functional positions. A first position is located at a side of the water-inlet pipe 94 to close one water-diverting chamber 93. A second position is located at another side of the water-inlet pipe 94 to close another one water-diverting chamber 93. A third position is in a put-away state or disconnected state, and two inlets of the water-inlet pipe 94 are both in communication. With the interception plate, the diverter 90 can independently control water supply to each of the water-diverting chambers 93.

There may be a plurality of types of connection, which can be provided between the spraying duct 20 and the water-outlet pipe 95. For example, the spraying duct is connected to the water-outlet pipe 95 directly or by a hose, such as a short hose.

In some embodiments, a powerful cleaning area, a gentle cleaning area, and a moderate cleaning area and the like can be formed by cooperation between the three position of the interception plate and a power of the water pump. An example is described hereinafter. When the interception plate is located at the first position, an area which is not closed is the powerful cleaning area, and the power of the water pump is increased. When the interception plate is located at the second position, an area which is not closed is the gentle cleaning area, and the power of the water pump is decreased. When the interception plate is located at the third position, the two cleaning areas are both the moderate cleaning areas, and the power of the water pump is between the power for powerful cleaning and the power for gentle cleaning.

In the embodiment with the diverter valve 80, the pressure-maintaining duct 50 can be arranged at a water path between the water pump 402 and the diverter valve 80, or the pressure-maintaining duct 50 is arranged at a water path between the diverter valve 80 and the diverter 90. It is noteworthy that, in this embodiment, arrangement of the pressure-maintaining duct 50 needs to guarantee independent control to the water supply system. When the pressure-maintaining duct 50 is located at a water path between the water pump 402 and the diverter valve 80, the water inflow end 51 of the pressure-maintaining duct 50 is in communication with the water pump 402, and the water outflow end 52 is in communication with the inlet of the diverter valve 80. When the pressure-maintaining duct 50 is located between the diverter valve 80 and the diverter 90, it is needed to provide a plurality of flow passages to the pressure-maintaining duct 50 to guarantee correspondence between the water output parts of the diverter valve 80 and the water inlet 91 of the diverter 90. For example, one of the water output parts corresponds to one of the flow passages of the pressure-maintaining duct 50, and a first water inlet 91.

An embodiment is described hereinafter, and a plurality of water supply systems can be individually controlled.

Figure 13:
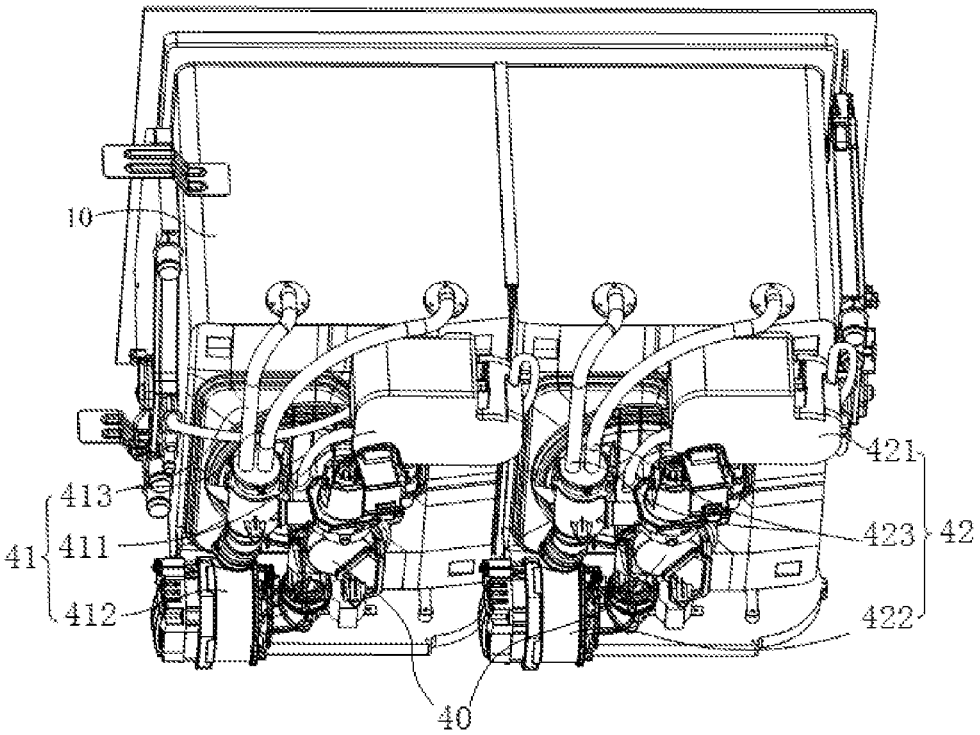
FIG. 13 is a schematic view of a water supply system of a dish washer.
Figure 14:
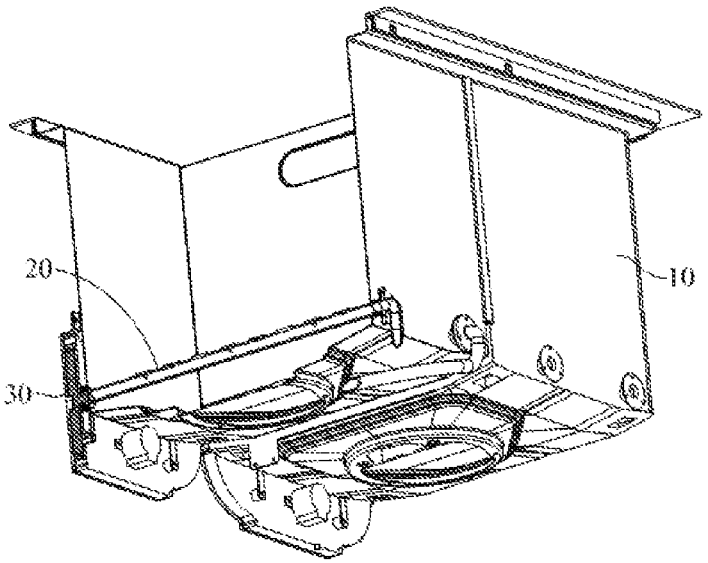
FIG. 14 is a sectional schematic view of a dish washer.

Referring to FIG. 12 to FIG. 14, the dish washer proposed by the present disclosure includes the container 10 and the spraying ducts 20. The container 10 has a plurality of cleaning areas, each of the cleaning areas is provided with one water supply system 40 correspondingly; that is, a plurality of water supply systems 40 are provided, and the plurality of water supply systems 40 correspond to the plurality of cleaning areas one to one. The spraying ducts 20 are arranged in the cleaning areas, the spraying ducts 20 are provided with a plurality of spraying holes, and the spraying ducts 20 have water inflow ends in communication with the water supply systems 40.

Since the dish washer provided by the present disclosure is provided with the plurality of water supply systems, cleaning can be performed in different cleaning areas at the same time without a diverter valve. Moreover, since different cleaning areas are in communication with different water supply systems which are independent from each other, the different water supply systems can be provided with different cleaning intensities, cleaning of different intensities can be performed in different cleaning areas at the same time, such that tableware of different dirty degrees can be cleaned differently, and water can be saved on the premise that the tableware can be cleaned satisfactorily.

For example, two cleaning areas and two the water supply systems can be provided. A first water supply system can be provided with a high water pressure, and a second water supply system can be provided with a normal water pressure, so as to perform different cleaning in different areas. For example, when the first water supply system is started and the second water supply system is stopped, powerful cleaning can be performed. When the first water supply system is stopped and the second water supply system is started, normal cleaning can be performed. When the first water supply system and the water supply system are both started, both of the powerful cleaning and the normal cleaning can be performed at the same time.

A design of the present disclosure is not limited thereto. In other embodiments, three, four, or more cleaning areas can be provided, and each of the cleaning area is provided with one water supply system, such that different water supply systems are configured to perform cleaning of different intensities, thereby achieving various cleaning effects.

Furthermore, as shown in FIG. 14, the dish washer further includes a driving device 30, the spraying duct 20 further has a driving end, and the driving device 30 is connected to the driving end of the spraying duct 20 in a transmission mode.

The driving device 30 is configured to drive the spraying duct 20 to rotate about an axis of the spraying duct 20.

Since a spraying arm is replaced with the spraying duct 20 in the dish washer provided by the present disclosure, the spraying duct 20 rotates about the axis to change a spraying angle, thereby changing a cleaning range, such that at least two kinds of beneficial effects can be achieved as follows. Firstly, the spraying duct 20 is small in size and occupies a small space, such that the sink dish washer can have a larger containing space. In addition, since the spraying duct 20 rotates about its own axis, the spraying duct 20 occupies a space that is equal to its actual volume, such that it is can be ensured that the sink of the dish washer have a larger containing space. Secondly, since the spraying duct 20 is controlled by the driving device 30, a rotation angle of the spraying duct 20 can be accurately controlled, a cleaning angle and range of the spraying duct 20 can be accurately controlled, such that a dead area during cleaning can be prevented and the tableware can be thoroughly cleaned.

In an embodiment of the present disclosure, as shown in FIGS. 12 and 13, the container 10 includes a plurality of separated washing tanks 11, and each of the washing tanks defines a cleaning area therein. For example, in this embodiment, the container 10 includes a first washing tank 11 and a second washing tank 12, which are separated from each other. The first washing tank 11 defines a first cleaning area therein, and the second washing tank 12 defines a second cleaning area therein. The water supply system includes a first water supply system 41 and a second water supply system 42, the first water supply system 41 corresponds to the first cleaning area, and the second water supply system 42 corresponds to the second cleaning area.

The first cleaning area can be configured as a normal cleaning area, and the second cleaning area can be configured as a powerful cleaning area. The water supply system 40 is configured as a dual-water path system, and the first water supply system 41 and the second water supply system 42 of the dual-water path system are provided with different intensities, such that powerful cleaning and gentle cleaning can be performed at different areas during a single cleaning, and the user can clean tableware of different dirty degrees differently.

In addition, the tableware can be cleaned with different degrees when passing through cleaning areas of different intensities in sequence. For example, the tableware to be cleaned can enter the powerful cleaning area firstly to be cleaned for flushing away food debris, and subsequently the tableware enters the normal cleaning area to be cleaned for thoroughly cleaning oil dirt.

The design of the present disclosure is not limited to the above-described embodiments. In other embodiments, the first washing tank 111 can also be in communication with the second washing tank 112, such that the tableware can be conveniently transferred from the powerful cleaning area to the normal cleaning area.

Furthermore, referring to FIG. 2 and FIG. 3, in order to conveniently change a volume of a containing space of the container 10, in an embodiment of the present disclosure, the container 10 is provided with a movable partition plate 60, such that the washing tank 11 can be separated into the first washing tank 111 and the second washing tank 112. When the partition plate 60 is mounted, the partition plate 60 partitions the container 10 into the first washing tank 111 and the second washing tank 112, and when the partition plate 60 is dismounted, the first washing tank 111 is in communication with the second washing tank 112, such that the container 10 can contain tableware of a larger size, such as a cookware, a large dish, etc.

A detachable structure for the partition plate 60 is described in detail now. In this embodiment, an inner wall of the container 10 is provided with a groove extending along an up-down direction, the partition plate 60 is mounted in the groove in a drawable mode. As an optimal implementation, an upper portion of the partition plate 60 is provided with a grip recess, such that the partition plate 60 can be easily held and pulled.

Furthermore, referring to FIG. 2 and FIG. 3, in order to improve leak-proofness of the partition plate 60 (that is, in order to prevent water from leaking through the partition plate 60), in an embodiment of the present disclosure, a bottom wall of the container 10 is provided with a protruding sealing wall corresponding to the partition plate 60. A bottom of the partition plate 60 sealingly abuts the sealing wall. With the sealing wall, a position of the partition plate 60 is raised, a water pressure at a seam between the partition plate 60 and the container 10 can be reduced, thereby improving sealing performance of if the partition plate 60, and preventing water from flowing from the first washing tank 11 to the second washing tank 12, and vice versa.

As an exemplary embodiment, a top of the sealing wall 70 is provided with a groove, the bottom of the partition plate 60 is fittingly embedded in the groove. The sealing performance of the partition plate 60 can be further improved, and strength of a connection between the partition plate 60 and the container 10 can be improved.

Furthermore, a structure for mounting the water supply system is described. In this embodiment, the partition plate 60 is arranged at a middle portion of the container 10, and the first water supply system 41 is arranged at an outer wall surface of a bottom of the first washing tank 111. The second water supply system 42 is arranged at an outer wall surface of a bottom wall of the second washing tank 112, and the first water supply system 41 and the second water supply system 42 are symmetrically arranged about a plane where the partition plate 60 is. Since the partition plate 60 is arranged at a middle portion of the container 10, the first washing tank 111 and the second washing tank 112 are symmetrical in structure. In addition, the first water supply system 41 and the second water supply system 42 have similar structures and a same weight, the first water supply system 41 is mounted to a bottom wall surface of the first washing tank 111, and the second water supply system 42 is mounted to a bottom wall surface of the second washing tank 112, such that the dish washer can have a symmetrical and stable structure.

Furthermore, referring to FIG. 4 and FIG. 7, the water supply system 40 includes the cup assembly 404, the water pump 402, and the water supply duct 403, which are connected in sequence. A water inflow end of the water supply duct 403 is in communication with the water pump 402, and a water outflow end of the water supply duct 403 is in communication with the spraying duct 20. In order to soft water for washing in the dish washer, in an embodiment of the present disclosure, the water supply system 40 further includes the water softener 401.

As an exemplary embodiment, in order to enable the dish washer to have a more stable structure, the water softener 401 and the water pump 402 of the water supply system are arranged in a diagonal line of a bottom wall of the washing tank 11, and the cup assembly 404 of the water supply system 40 is located between the water softener 401 and the water pump 402.

For example, the water outflow end of the water supply duct 403 is in communication with the spraying duct 20 through the pressure-maintaining duct 50, and the diameter of the pressure-maintaining duct 50 is greater than that of the water supply duct 403, such that a water pressure in the water supply duct 403 is more stable.

For example, as shown in FIG. 13, the first water supply system 41 includes a first water softener 411, a first cup assembly, a first water pump 412, a first water supply duct 413, and a first connecting pipe, which are connected in sequence. The first connecting pipe enables the first water softener 411, the first cup assembly, and the first water pump 412 to be in communication with each other. The first water pump 412 and the first water softener 411 are arranged at the diagonal line of the bottom wall of the first washing tank 111; and/or the second water supply system 42 includes a second water softener 421, a second cup assembly, a second water pump 422, a second water supply duct 423, and a second connecting pipe which are connected in sequence, and the second connecting pipe enables the second water softener 421, the second cup assembly, and the second water pump 422 to be in communication with each other. The second water pump 422 and the second water softener 421 are arranged at the diagonal line of the bottom wall of the second washing tank 112.

Furthermore, referring to FIG. 13, in order to achieve more compact arrangement of the first water supply system 41 and the second water supply system 42, in an embodiment of the present disclosure, the first water supply system 41 and the second water supply system 42 are arranged at an offset mode. For example, the first water softener 411 extends towards a side of the second water supply system 42, and/or, the second water pump 52 extends towards a side of the first water supply system 41.

The above description is merely exemplary embodiments of the present disclosure and not intended to limit the patent scope of the present disclosure, and any equivalent structural variations made by using the description and accompanying drawings of the present disclosure or applied directly or indirectly in other relevant technical fields are also included in the scope of patent protection of the present disclosure.

What is claimed is:

1. A sink-type dish washer comprising:

a container defining a cleaning area therein;

a plurality of spraying devices, each of the spraying devices comprising a spraying duct, and the spraying duct being provided with a spraying hole and having a water inflow end; and at least one water supply system in communication with a water supply and the water inflow end of each of the spraying ducts, wherein each one of the plurality of spraying devices is configured to supply water to the cleaning area individually and independently, wherein the at least one water supply system comprises a cup assembly, a water pump, and a water supply duct which are connected in sequence, wherein the water supply duct has a water inflow end in communication with the water pump and a water outflow end in communication with each of the spraying ducts, and wherein the water outflow end of the water supply duct is in communication with each of the spraying ducts through a pressure-maintaining duct.

2. The sink-type dish washer as claimed in claim 1, further comprising a diverter valve, wherein the diverter valve has a water inlet end connected to the water supply system; and wherein the diverter valve comprises a plurality of water output parts, each of the water output parts is in communication with a respective spraying device, and the plurality of spraying devices are controlled to supply water to the cleaning area by correspondingly controlling opening and closing of the plurality of water output parts.

3. The sink-type dish washer as claimed in claim 2, further comprising a diverter, wherein the diverter has a water inlet, a water outlet, and a water-diverting chamber in communication with the water inlet and the water outlet, and wherein the water inlet is in communication with the water output parts, and the water outlet is in communication with a water inflow end of each one of the plurality of spraying devices.

4. The sink-type dish washer as claimed in claim 1, wherein the pressure-maintaining duct is provided in a water path between the at least one water supply system and a diverter valve or provided in a water path between the diverter valve and a diverter.

5. The sink-type dish washer as claimed in claim 1, wherein the at least one water supply system comprises a plurality of water supply systems, each of the spraying devices corresponds to a respective water supply system, and the plurality of spraying devices are controlled to provide water to the cleaning area by controlling the plurality of water supply systems respectively.

6. The sink-type dish washer as claimed in claim 5, wherein a plurality of cleaning areas are provided, wherein the plurality of cleaning areas comprise a first cleaning area and a second cleaning area, and the plurality of water supply systems comprise a first water supply system and a second water supply system, wherein the first water supply system corresponds to the first cleaning area, the second water supply system corresponds to the second cleaning area, and wherein the first water supply system comprises a first cup assembly, a first water pump, and a first water supply duct which are connected in sequence, and the second water supply system comprises a second cup assembly, a second water pump, and a second water supply duct which are connected in sequence.

7. The sink-type dish washer as claimed in claim 6, wherein the first water supply system further comprises a first water softener, the first water softener is connected to the first cup assembly, and the first water pump and the first water softener are arranged at a diagonal line of a bottom wall of a first washing tank; and wherein the second water supply system further comprises a second water softener, the second water softener is connected to the second cup assembly, and the second water pump and the second water softener are arranged at a diagonal line of a bottom wall of a second washing tank.

8. The sink-type dish washer as claimed in claim 1, wherein the pressure-maintaining duct has a diameter greater than a diameter of the water supply duct.

9. The sink-type dish washer as claimed in claim 1, wherein the pressure-maintaining duct has an axis parallel to an axis of a water outlet opening of the water pump, and an offset distance is provided between the axis of the pressure-maintaining duct and the axis of the water outlet opening of the water pump.

10. The sink-type dish washer as claimed in claim 1, wherein the pressure-maintaining duct has a water inflow end provided with an inlet port, the inlet port is smaller than a diameter of the pressure-maintaining duct, and the inlet port is formed at a side of the pressure-maintaining duct adjacent to the water pump.

11. The sink-type dish washer as claimed in claim 1, wherein the container has a washing tank therein, the washing tank is provided with a movable partition plate therein, and the partition plate partitions the washing tank into a plurality of cleaning areas.

12. The sink-type dish washer as claimed in claim 11, wherein the plurality of spraying ducts are arranged along a length direction or a width direction of the washing tank.

13. The sink-type dish washer as claimed in claim 11, wherein a bottom of the cleaning area is provided a protruding sealing wall corresponding to the partition plate, and a bottom of the partition plate sealingly abuts the sealing wall.

* * * * *